United States Patent [19]

Truppe

[11] Patent Number: 4,996,822

[45] Date of Patent: Mar. 5, 1991

[54] COIN WRAPPING DEVICE

[76] Inventor: Robert B. Truppe, 14 Derby Ln., Dumont, N.J. 07628

[21] Appl. No.: 531,692

[22] Filed: Jun. 1, 1990

Related U.S. Application Data

[63] Continuation-in-part of Ser. No. 428,773, Oct. 30, 1989, abandoned.

[51] Int. Cl.[5] ..... B65B 11/56; B65B 67/08

[52] U.S. Cl. ..... 53/213; 53/216; 53/390; 53/592

[58] Field of Search ..... 53/216, 213, 212, 390, 53/211, 214, 203, 219, 592, 139.3

[56] References Cited

U.S. PATENT DOCUMENTS

| | | | |
|---|---|---|---|
| 217,396 | 7/1879 | Newbill . | |
| 2,043,830 | 6/1936 | Grant et al. . | |
| 2,540,090 | 2/1951 | Brackney . | |
| 2,637,960 | 5/1953 | Powers . | |
| 2,661,582 | 12/1953 | Hanser | 53/213 |
| 3,533,501 | 10/1970 | Dorsett . | |
| 3,748,824 | 7/1973 | Kerr | 53/213 |
| 3,783,586 | 1/1974 | Dorman | 53/213 |
| 3,799,428 | 3/1974 | Lamming | 229/87.2 |
| 3,981,395 | 9/1976 | Dalgeish | 281/82 |
| 4,546,875 | 10/1985 | Zweber | 206/82 |
| 4,765,464 | 5/1988 | Ristvedt | 206/82 |

FOREIGN PATENT DOCUMENTS

| | | |
|---|---|---|
| 1061250 | 7/1959 | Fed. Rep. of Germany . |

*Primary Examiner*—James F. Coan
*Attorney, Agent, or Firm*—Bacon & Thomas

[57] ABSTRACT

A device for wrapping coin rolls includes a base supporting a pad of wrapper sheets for wrapping a roll of coins initially supported by an end wall and two side walls located at one end of the base. The end wall is spaced a distance less than the diameter of the coin roll from the adjacent edge of the wrapper sheet pad so that the coins rest at the edge of the pad before starting each wrapping procedures. Strips of contact adhesive on the upper side of the wrapper sheets holds the wrapper to the coins and causes the wrapper sheet to adhere to itself when the wrapping is completed.

7 Claims, 2 Drawing Sheets

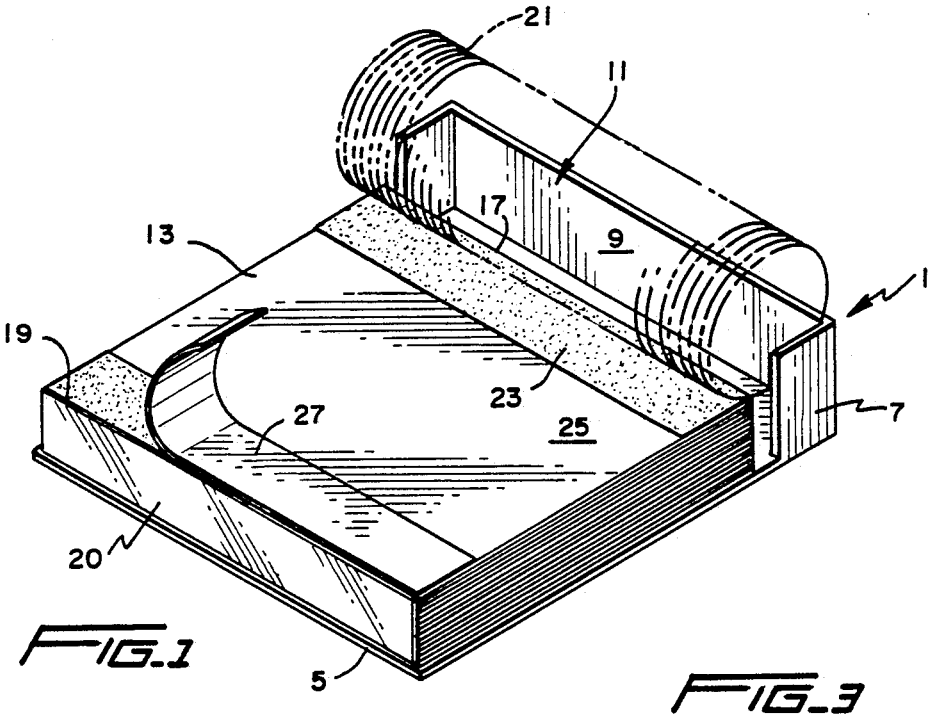
FIG. 1
FIG. 3
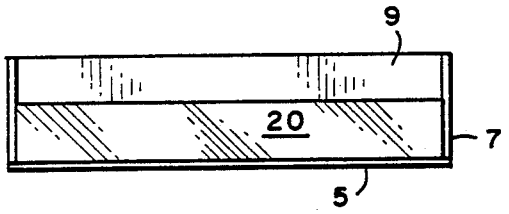
FIG. 2
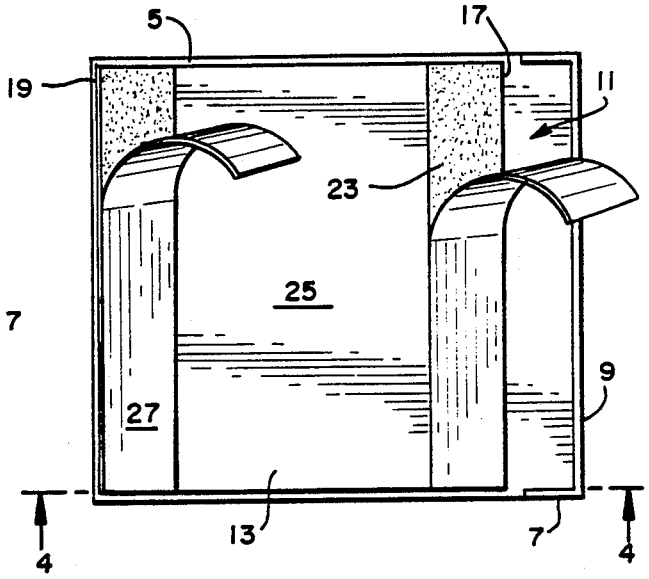
FIG. 4
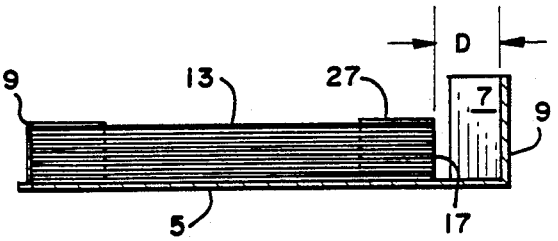

FIG. 5
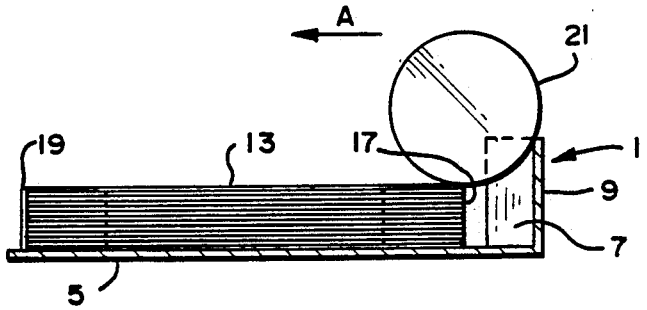
FIG. 6
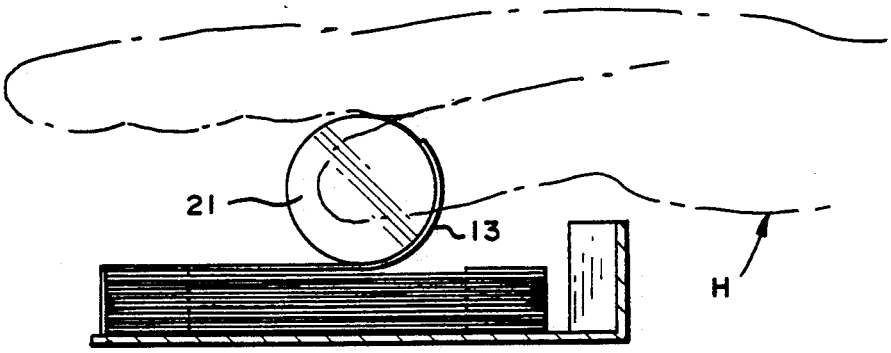
FIG. 7
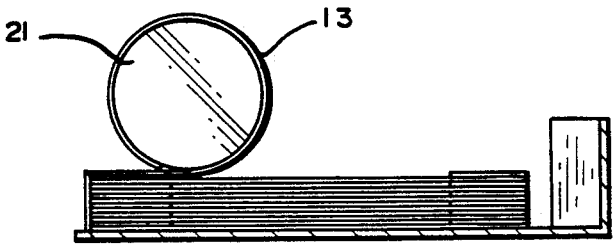
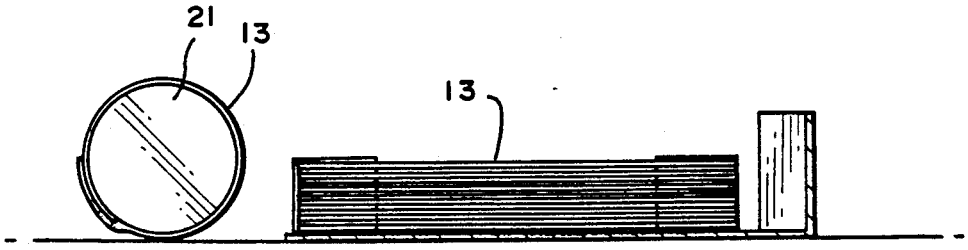
FIG. 8

COIN WRAPPING DEVICE

CROSS REFERENCE TO RELATED APPLICATIONS

This application is a continuation in part of patent application Ser. No. 428,773 filed Oct. 30, 1989 and now abandoned.

BACKGROUND OF THE INVENTION

1. Field of the Invention

The present invention generally involves the field of technology pertaining to devices for manually wrapping articles in a flexible wrapper. More specifically, the invention relates to an improved device for wrapping a roll of coins, tokens or the like by a flexible wrapper sheet to form a wrapped roll thereof.

2. Description of the Prior Art

To facilitate the counting and handling of money in coin form, it is a conventional practice to assemble a stack of coins of the same denomination in a face-to-face relationship to form a roll thereof so that only the edges of the stacked coins and external faces of the outermost coins at the opposite ends of a roll are visible. The coin roll is thereafter wrapped by a flexible sheet of material, such a paper or plastic, to form a wrapped roll having a specified monetary value. The wrapped rolls are then easily counted, handled and transferred between banks and business locations or other financial institutions.

The forming of a wrapped coin roll usually involves two different procedures. First, the coins must be separated according to denomination in a given number to establish the desired monetary value. This step may be realized manually or through the assistance of coin counting and stacking devices Second, the stack of coins in roll form is then wrapped by a rectangular-shaped sheet of wrapping paper, the length of which exceeds the length and the width of which exceeds the circumference of the coin roll. In this way, the wrapper may overlap itself around the roll and the opposite ends of the wrapper may be folded inwardly against the external faces of the outermost coins to secure the wrapper in place.

It is known to provide wrapping paper that is preformed into an open-ended cylindrical tube having a diameter corresponding to the diameter of the coins, so that the coin roll may be inserted and centered within the tube, and the opposite ends of the tube be folded inwardly to secure the roll therein. It is also known to provide flat sheets of coin wrappers having releasable adhesive on one side of the wrapper to secure the wrapper against the edges of the coins forming the roll, wherein the length of the wrapper is substantially the same as or greater than the length of the roll. Various devices and machines for forming wrapped rolls of coins with wrappers of the types described herein are also well known.

Examples of wrappers for coins and other disc-shaped articles, and devices for applying such wrappers are disclosed by the Newbill U.S. Pat. Nos. 217,396, Grant et al 2,043,830, Powers 2,637,960, Dorman 3,783,586, Lamming 3,799,428, Dalgleish 3,981,395, Zweber 4,546,875 and Ristvedt 4,765,464.

SUMMARY OF THE INVENTION

It is an object of the present invention to provide an improved device for wrapping a cylindrical-shaped object, such as a roll of coins, tokens or similar disc-shaped articles, in a flexible wrapper sheet.

It is another object of the invention to provide an improved device for wrapping a roll of coins in a rectangular-shaped wrapper sheet provided with adhesive for securing the sheet to the coin roll.

It is a further object of the invention to provide an improved device which is extremely simple in construction and economical to manufacture for quickly and easily forming wrapped coin rolls.

It is yet another object of the invention to provide an improved device for forming a wrapped coin roll wherein the external faces of the outermost coins at the opposite ends of the roll are exposed, and without the necessity of folding end portions of the wrapper inwardly against the external faces to secure the wrapper to the roll.

These and other objects of the invention are realized by providing a coin wrapping device which includes a wrapping sheet support area on a bottom wall, a pair of opposed spaced side walls supported by the bottom wall and a single end wall extending between the sidewalls, thereby forming an end compartment having an open end facing the sheet support area. A stack or pad of correspondingly sized rectangular-shaped wrapper sheets preferably adhesively connected at their terminal ends are disposed on the sheet support area of the device, with the leading edges of the sheets being located adjacent the end compartment and spaced inwardly from the end wall a distance less than the diameter of the coin roll. Each wrapper sheet includes a leading edge adjacent the end wall and a terminal edge adjacent the opposite end of the sheet support area. Areas of pressure sensitive adhesive (i.e., pressure activated adhesive) are provided along the leading and terminal edges of each sheet and the adhesive is preferably covered by releasable protective coverings. The length of each sheet corresponds to the length of the coin roll and the sheet width is at least equal to the circumference of the roll of coins to be wrapped, but preferably longer than the circumference to provide overlap of the terminal edge of the sheet with the leading edge when the roll is fully wrapped.

Other objects, features and advantages of the invention shall become apparent from the following detailed description of a preferred embodiment thereof, when taken in conjunction with the drawings wherein like reference characters refer to corresponding parts in the several views.

BRIEF DESCRIPTION OF THE DRAWINGS

FIG. 1 is a perspective view showing a coin wrapping device according to a preferred embodiment of the invention, and depicted with a roll of coins in phantom lines positioned at the leading edge of the uppermost wrapper sheet.

FIG. 2 is an end elevational view of the device showing a pad of wrapper sheets disposed on the bottom wall of the device.

FIG. 3 is a top plan view of the device showing the releasable protective strips being partially peeled away from the adhesive areas on the uppermost wrapper sheet.

FIG. 4 is a cross sectional view taken along the line 4—4 of FIG. 3.

FIGS. 5–8 depict the sequential steps in using the device to form a wrapped roll of coins.

DETAILED DESCRIPTION OF THE PREFERRED EMBODIMENT

A coin wrapping device 1 according to a preferred embodiment of the invention shall now be described with initial reference to FIGS. 1–4 of the drawings.

As shown in FIG. 1, wrapping device 1 includes a bottom wall 5 preferably of generally square or rectangular configuration. A pair of upstanding sidewalls 7 are supported by an extend above the bottom wall 5 and are connected by an upstanding end wall 9 also connected to the bottom wall 5 in this embodiment. A plurality of wrapper sheets 13 are disposed in pad formation on a wrapper sheet support area of bottom wall 5 in a stacked array. The pad preferably includes a terminal end wall 20 comprises an adhesive binding for the sheets 13 along terminal edges 19 of the sheets. The wrapper sheets 13 are disposed on the bottom wall between imaginary vertical planes that includes the sidewalls 7, although, if desired, side walls 7 could be extended any desired length along bottom wall 5.

Wrapper sheets 13 include a plurality of leading edges 17 and a plurality of terminal edges 19. As apparent in FIG. 1, leading edges 17 are coplanar and spaced inwardly from end wall 9 adjacent open end 11, while terminal edges 19 are adjacent the forward edges of bottom wall 5. The internal distance between side walls 7 defines a length of compartment 1; substantially equal to the length of sheets 13 extending therebetween, thus positioning sheets 13 coextensively with the upper surface of bottom wall 5 adjacent the open end of compartment 11. This relationship and the coplanar relationship between sheets 13, bottom wall 5 and side walls 7 is clearly shown in FIG. 2 wherein device 1 is viewed from the end of bottom wall 5.

As also apparent in FIG. 1, a roll of coins 21, shown in phantom lines, is supported within compartment 11 by end wall 9, leading edge 17 and end walls 17 in its initial position for wrapping by the uppermost wrapper sheet 13. Roll 21 contains a plurality of coins of the same diameter and preferably of the same thickness and denomination so that roll 21 is of a cylindrical configuration and provides a predetermined monetary value. The individual coins forming roll 21 are disposed in adjacent face-to-face relationship so that only the edges of the individual coins and the exterior faces of the outermost coins at the opposite ends of roll 21 are visible. The length of compartment 11 is substantially the same as the length of roll 21 so that the latter fits snugly between and is supported by side walls 7, but is permitted to roll forwardly from the end wall 9 to the trailing edge 19 of sheets 13. As also seen in FIG. 1, and more particularly shown in FIG. 4, leading edges 17 of sheets 13 are spaced a distance D from the inner surface of end wall 11. Distance D is less than the diameter of coin roll 21, thereby permitting roll 21 to be supported between an area adjacent leading edge 17 of the uppermost sheet 13 and end wall 11. This serves to maintain roll 21 in a stationary position for wrapping in a manner which shall be later detailed. The coin roll 21 engages the leading edge 17 of the top most sheet of the pad 13 at substantially the same point as the pad is used up. Thus, the distance D preferably is not less than the radius of the roll 21, but not greater than the diameter of the roll.

With reference to FIG. 3, it can be seen that each wrapper sheet 13 is of a substantially planar configuration and formed from appropriate flexible material, such as paper, plastic or the like. Each sheet 13 is provided with two areas of adhesive 23 on an upper surface 25 thereof. Areas 23 are each preferably of a strip configuration and extend coextensively along leading edge 17 and terminal edge 19.

The adhesive constituting each area 23 is preferably any appropriate known pressure-sensitive, contact activated releasable adhesive having good tack and shear properties but low peel adhesion to metal. The adhesive should be capable of adhering quickly to the outer edge surfaces of a roll of coins and have sufficient sheer strength to securely retain the coins within wrapper sheet 13 during handling, and yet have a peel adhesion low enough to be effectively clean-releasing to permit sheet 13 to be readily removed from coin roll 21 without leaving any substantial residue of adhesive on the coins and without tearing sheet 13. Adhesives suitable for the practice of this invention are well known and include those disclosed by the Ristvedt U.S. Pat. No. 4,765,464, the entire disclosure of this patent being incorporated herein by reference.

As also seen in FIGS. 1 and 3, adhesive areas 23 are each provided with a protective strip 27 which are initially peeled away to expose layers 23 just prior to wrapping coin roll 21. Strips 27 may be formed from any suitable material well known in the art for this specific requirement.

The manner in which device 1 is used to wrap coin roll 21 shall now be described with sequential reference to FIGS. 5–8.

As first seen in FIG. 5, coin roll 21 is initially disposed within compartment 11 in the same position previously indicated in FIG. 1. Protective strips 27 have been removed from adhesive layers 23 of the uppermost wrapper sheet 13 and coin roll 21 is maintained in an assembled stationary position between leading edge 17 of uppermost sheet 13 and back wall 9. This is realized because a portion of roll 21 extends into the space formed between leading edges 17 of sheets 13 and end wall 9. Wrapping of roll 21 in sheet 13 is achieved by rolling roll 21 from the rear of casing 3 to its front open end 15 in the direction indicated by Arrow A.

With reference to FIG. 6, rolling of coin roll 21 may be achieved by the hand H of a user, and is initiated by first rolling roll 21 from its stationary position onto adhesive layer 23 adjacent leading edge 17. This causes leading edge 17 and the adjacent portion of sheet 13 containing adhesive layer 23 to become attached to longitudinally aligned edge portions of the coins forming roll 21 and serves to maintain roll 21 in its assembled form. Since roll 21 is in sliding and supporting engagement between side walls 7, roll 21 is secured longitudinally thereby, while adhesive layer 23 adjacent leading edge 17 secures roll 21 transversely.

Continued rolling of roll 21, as depicted in FIG. 7, eventually causes sheet 13 to be completely wrapped around the circumference of roll 21, at which point adhesive layer 23 adjacent terminal edge 19 is reached. Further rolling of roll 21 preferably causes sheet 13 to overlap and attach to itself by adhesive layer 23 adjacent edge 19. The lengths of sheets 13 are therefore preferably longer than the circumference of coins 21.

The completely wrapped coin roll is shown removed from device in FIG. 8. Since adhesive layers 23 are positioned adjacent and along leading and terminal edges 17, 19 of sheet 13, and sheet 13 is of the same length as coin roll 21, coin roll 21 remains securely wrapped while permitting the external faces of the outermost coins at the opposite ends of roll 21 to be fully exposed. This affords the dual advantage of utilizing a minimum of material for forming sheet 13 and permitting visual identification of the type of coins making up roll 21. Disassembly of wrapped coin roll 21 may be realized by either peeling away sheet 13 along terminal edge 19 or striking the side of wrapped roll 21 against a sharp edge to rupture sheet 13.

The invention therefore provides an improved device for quickly and easily wrapping a roll of coins without the necessity of crimping or folding the ends of a wrapper sheet inwardly against the opposite ends of the coin roll. The device 1 may be formed from a disposable material, such as cardboard, thereby significantly reducing the cost of making device 1. It is preferred that sheets 13 be formed of paper or other suitable inexpensive wrapping material. Though only portions of upper surface 25 of sheet 13 is shown to be provided with adhesive layers 23, it is also understood that other adhesive configurations may be utilized, including covering top surface 25 of sheet 13 entirely with adhesive and providing same with a correspondingly sized protective strip 27. The pad of sheets also may be adhesively secured to the bottom wall 5 or by any other suitable means While the invention has been particularly described for preferred use in the wrapping of coins, it is understood that device 1 may also be utilized to advantage in the wrapping of rolls formed from other disc-shaped articles or even solid cylindrical articles.

Though the invention has been described and illustrated with reference to a preferred embodiment thereof, those skilled in the art will appreciate that various changes and modifications in shape, size, composition and arrangement of parts may be resorted to without departing from the spirit of the invention or scope of the subjoined claims.

What is claimed is:

1. A device for wrapping a cylindrical roll comprising:

a bottom wall including a wrapper sheet support area;

a pair of upstanding sidewalls supported by the bottom wall and spaced apart a distance substantially equal to the length of a cylindrical roll to be wrapped;

an upstanding end wall extending between and connected to the sidewalls;

said wrapper sheet support area lying at least between imaginary planes including the sidewalls;

at least one wrapper sheet including a leading edge and a terminal edge disposed on the wrapper sheet support area;

said wrapper sheet including a contact activated adhesive area on its upper surface at least adjacent said leading edge for engaging the periphery of a cylindrical roll to be wrapped;

the leading edge of the wrapper sheet being spaced a distance D away from the end wall, said distance being less than the diameter of the cylindrical roll to be wrapped.

2. A device as claimed in claim 1, wherein the distance D is not less than the radius of the cylindrical roll to be wrapped.

3. A device as claimed in claim including a second contact activated adhesive area adjacent said terminal edge of said wrapping sheet.

4. A device as claimed in claim 1, 2 or 3, including protective temporary coverings for said adhesive areas.

5. A device as claimed in claim 1, 2 or 3, including multiple wrapper sheets arranged in a unitary pad form wherein the sheets are joined together along their terminal edge areas.

6. A device as claimed in claim 1, 2 or 3, wherein the width of said wrapper sheet between its leading and terminal edges is greater than the circumference of a roll to be wrapped.

7. A device as claimed in claim 6, including multiple wrapper sheets arranged in a pad formation wherein the sheets are adhesively connected together along their terminal edge areas.

* * * * *

UNITED STATES PATENT AND TRADEMARK OFFICE

CERTIFICATE OF CORRECTION

PATENT NO. : 4,996,822

DATED : March 5, 1991

INVENTOR(S) : Robert B. Truppe

It is certified that error appears in the above-identified patent and that said Letters Patent is hereby corrected as shown below:

Col. 3, line 28, numeral "1" should read --11--.
Col. 3, line 38, "end" (second occurrence) should read --side--; numeral "17" (second occurrence) should read --7--.
Col. 3, line 55, numeral "11" should read --9--.
Col. 3, line 58, numeral "11" should read --9--.
Col. 4, line 40, "casing 3" should read --device 1--.
Col. 4, line 41, numeral "15" should be deleted.

Signed and Sealed this

Thirteenth Day of October, 1992

*Attest:*

DOUGLAS B. COMER

*Attesting Officer*

*Acting Commissioner of Patents and Trademarks*